US006082682A

United States Patent [19]

So et al.

[11] Patent Number: 6,082,682

[45] Date of Patent: Jul. 4, 2000

[54] MOUSE USER WRIST SUPPORT

[76] Inventors: Vincent So; Barbara So; Jonathan So; Stephen So, all of 529 Chapel Street, Ottawa, Ontario, Canada, K1N 8A1

[21] Appl. No.: 09/019,507

[22] Filed: Feb. 5, 1998

[51] Int. Cl.[7] ..... B68G 5/00

[52] U.S. Cl. ..... 248/118

[58] Field of Search ..... 248/118, 118.1, 248/118.5; 400/715; 602/64, 21

[56] References Cited

U.S. PATENT DOCUMENTS

| | | | |
|---|---|---|---|
| 709,114 | 9/1902 | Rockwell | 248/118.5 |
| 793,756 | 7/1905 | Williams | 248/118.5 |
| 986,620 | 3/1911 | Ballou | 248/118.5 |
| 1,510,877 | 10/1924 | Wiedenmann | 248/118.5 |
| 3,453,751 | 7/1969 | Kuhlman | 248/118.5 X |
| 5,165,630 | 11/1992 | Connor | 248/118.1 |
| 5,335,888 | 8/1994 | Thomsen | 248/118.1 X |
| 5,439,192 | 8/1995 | King | 248/118 |
| 5,472,161 | 12/1995 | Krukovsky | 248/118.5 |
| 5,556,061 | 9/1996 | Dickie | 248/51 |
| 5,628,483 | 5/1997 | Smith | 248/118 |
| 5,730,711 | 3/1998 | Kendall et al. | 248/118 X |

*Primary Examiner*—Ramon O. Ramirez
*Attorney, Agent, or Firm*—Litman, Kraai & Brown L.L.C.; John C. McMahon

[57] ABSTRACT

A computer-user wrist support for supporting the wrist during operation of a computer inputting device. A resilient cushion located at the underside of the wrist provides the support while fastening means, comprising an elongated radially-stretchable fabric tube with closure means, secure the resilient cushion in place against the wrist.

14 Claims, 1 Drawing Sheet

MOUSE USER WRIST SUPPORT

FIELD OF THE INVENTION

The present invention relates to a computer-user wrist support, and more particularly to a wrist support for achieving greater comfort while using a computer inputting device.

BACKGROUND OF THE INVENTION

The use of a keyboard, mouse, or other inputting device for a computer can lead to overuse of the forearm muscles, or to nerve compression at the wrist. This is caused by the upward angle at which the wrist is often cocked during use of such devices, and by the lack of support provided for the wrist.

It is known in the field to provide support for the wrist when using a computer inputting device by placing a cushion in front of the device. See for example, U.S. Pat. No. 5,628,483 which issued May 13, 1997 to Smith et al.; U.S. Pat. No. 5,165,630 which issued Nov. 24, 1992 to Connor; and U.S. Pat. No. 5,556,061 which issued Sep. 17, 1996 to Dickie. However, effective use of such supports requires that the cushion be properly positioned in front of the device to be used. Thus, if the keyboard or mouse is relocated to a different area of the desk, the cushion must also be relocated to be positioned in front of the device. This requires time and effort. Further, as a movable pointing device is moved about during use, the position of the wrist relative to the cushion changes, reducing the effectiveness of the support. Finally, such known supports necessarily occupy desk space, adding to the problem of desk clutter.

SUMMARY OF THE INVENTION

According to a broad aspect, the invention provides a computer-user wrist support for supporting the wrist during operation of a computer inputting device, comprising a resilient cushion, and cushion-fastening means for securing the resilient cushion against the underside of the wrist of the computer-user.

Advantageously, the invention provides support to the wrist during operation of a computer inputting device such as a mouse or keyboard, while eliminating the need to ensure that the support is properly positioned in front of the inputting device each time the inputting device is used. The invention also reduces the problem of desk clutter by eliminating the need to place any additional object on the desk to provide support for the wrist.

BRIEF DESCRIPTION OF THE DRAWINGS

Preferred embodiments of the invention will now be described with reference to the attached drawings in which.

DETAILED DESCRIPTION OF THE PREFERRED EMBODIMENT

Figure 1:
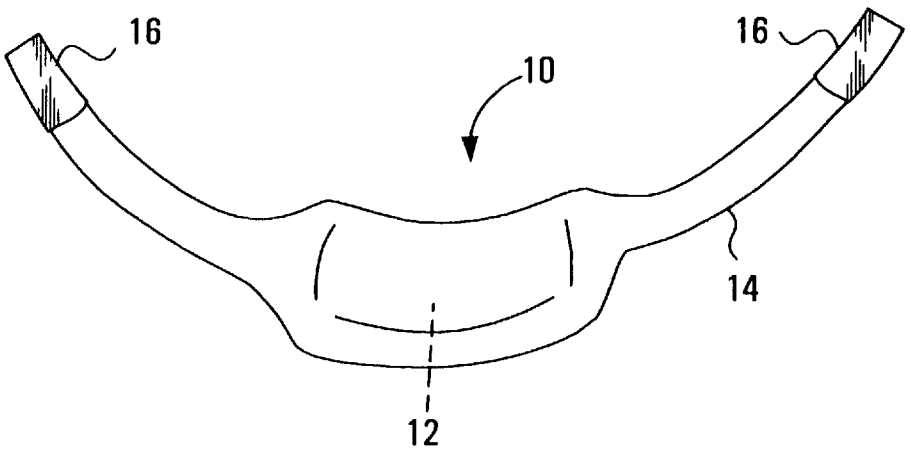
FIG. 1 is a perspective view of a wrist support according to an embodiment of the invention.
Figure 2:
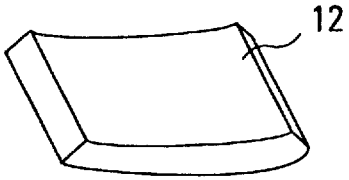
FIG. 2 is a perspective view of a resilient cushion located within the wrist support of FIG. 1.

FIG. 1 illustrates a wrist support 10 according to an embodiment of the invention. A resilient cushion 12 as illustrated in FIG. 2 is provided, along with a cushion-fastening device comprised of an elongated tube 14 within which the resilient cushion is located, and closure components 16. The resilient cushion 12 may be composed of compressible foam or other suitable material. The resilient cushion 12 is generally flat, though it may be curved in one or more directions, as shown for example in FIG. 2, to better fit the underside of the wrist. The resilient cushion 12 should be of sufficient thickness such that when it is located under the wrist, it raises the wrist to a level which provides maximum comfort while operating a computer inputting device. A thickness of one-half to three-quarters of an inch is suitable. The resilient cushion 12 should be of sufficient length and width so as to prevent excessive movement of the resilient cushion 12 relative to the wrist, as the wrist support 10 is moved about on the operating surface. However, the wrist support should not be so large as to become an impediment while performing other operations using the hands. A length and width of 2 to 3 inches is suitable.

The elongated tube 14 is composed of a fabric textile, and is of sufficient length to allow it to wrap around the wrist of the computer-user, with sufficient overlap to allow fastening of the two ends. The elongated tube 14 must be wide enough to accommodate the resilient cushion 12, but narrow enough to hold the resilient cushion 12 in place once it has been positioned within the elongated tube 14. To more effectively secure the resilient cushion 12 in place within the elongated tube 14, the elongated tube 14 is radially-stretchable. The elongated tube 14 may also be longitudinally-stretchable to provide greater comfort to the user, and to more securely fasten the resilient cushion 12 to the wrist.

At the ends of the elongated tube 14 are closure components 16 for fastening the two ends of the elongated tube 14 together. VELCRO™ releasable fastening components may be used. The mating portions of the closure components 16 are located on opposite sides of the elongated tube 14 such that they may be mated without needing to twist the elongated tube 14.

Figure 3:
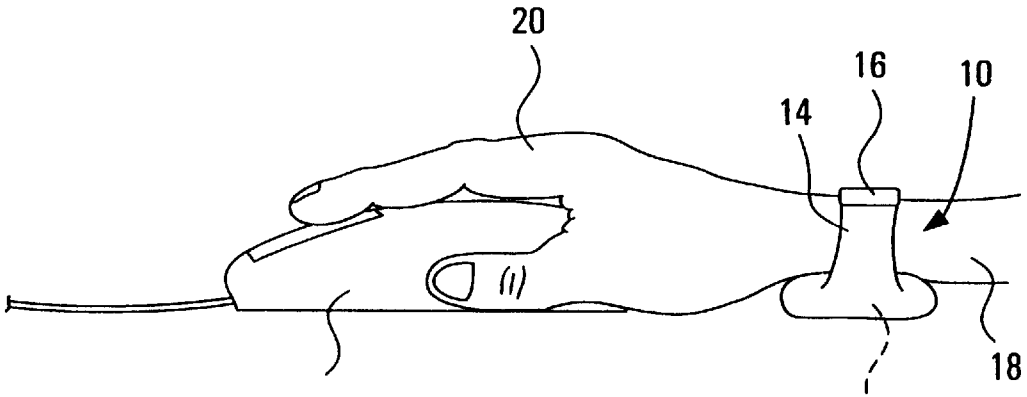
FIG. 3 is a side view of the wrist support of FIG. 1 fastened to the wrist of a computer-user.

In use, as illustrated in FIG. 3, the wrist support 10 is fastened to the wrist 18 of a user of a mouse 19. The resilient cushion 12 is positioned so as to be located on the underside of the wrist 18 while the closure components 16 are mated on top of the wrist 18 to hold the wrist support 10 in place. When fastened, the wrist support 10 serves to support the wrist 18, elevating it to a comfortable position relative to the hand 20.

A single wrist support may be used when operating a numerical keypad, or a pointing device such as the mouse 19, as shown in FIG. 3. When wrist support during operation of a keyboard is desired, two wrist supports may be used, one fastened to each wrist.

Although the elastic tube 14 is shown in the drawings as having two ends with closure components 16, it is to be understood that a closed-loop longitudinally-stretchable tube may also be used to fasten the wrist support 10 to the wrist 18.

Although the closure components 16 are shown in the drawings as being comprised of VELCRO fastening components, it is to be understood that other suitable fastening components may be used, for example a button, or hook-and-clasp arrangement.

Numerous modifications and variations of the present invention are possible in light of the above teachings. It is therefore to be understood that within the scope of the appended claims, the invention may be practised otherwise than as specifically described herein.

The embodiments of the invention in which an exclusive property or privilege is claimed are defined as follows:

1. A wrist support for providing support to the wrist of a computer-user during operation of a computer inputting device, said wrist having an underside which faces down when operating said computer inputting device, the wrist support comprising:

(a) a resilient cushion; and (b) an elongated radically-stretchable tube within which the resilient cushion is located for securing said resilient cushion against the underside of said wrist.

2. The wrist support of claim 1 wherein the resilient cushion is curved to fit the underside of the wrist.

3. The wrist support of claim 1 wherein the resilient cushion is composed of compressible foam, has a thickness of ½" to ¾" a width of 2 to 3 inches, and a length of 2 to 3 inches.

4. The wrist support of claim 1 wherein the elongated tube is longitudinally-stretchable.

5. The wrist support of claim 4 wherein the elongated tube has two ends, each end having closure components for fastening said two ends of the elongated tube together.

6. The wrist support of claim 5 wherein the closure components comprise VELCRO™ fastening components.

7. The wrist support of claim 1 wherein the elongated tube has two ends, each end having closure components for fastening said two ends of the elongated tube together.

8. A wrist support for supporting the wrist of a computer-user comprising:

(a) a resilient cushion; and (b) an elongated radially-stretchable tube within which the resilient cushion is located for securing the resilient cushion to the wrist.

9. The wrist support of claim 8 wherein the resilient cushion is curved to fit the underside of the wrist.

10. The wrist support of claim 8 wherein the elongated tube is longitudinally-stretchable.

11. The wrist support of claim 10 wherein the elongated tube has two ends, each end having closure components for fastening said two ends of the elongated tube together.

12. The wrist support of claim 8 wherein the elongated tube has two ends, each end having closure components for fastening said two ends of the elongated tube together.

13. The wrist support of claim 12 wherein the closure components comprise VELCRO™ fastening components.

14. The wrist support of claim 13 wherein the resilient cushion is composed of compressible foam, has a thickness of ½" to ¾", a width of 2 to 3 inches, and a length of 2 to 3 inches.

* * * * *